United States Patent [19]

Kunstler

[11] 4,006,693

[45] Feb. 8, 1977

[54] COMBUSTION FURNACE CONSTRUCTION PARTICULARLY A REFUSE INCINERATOR

[76] Inventor: Hans Künstler, Eulenweg 25, Zurich, Switzerland, 8048

[22] Filed: Nov. 15, 1973

[21] Appl. No.: 416,235

[30] Foreign Application Priority Data

Nov. 30, 1972 Switzerland ..... 17496/72

[52] U.S. Cl. ..... 110/8 R; 110/72 R; 110/75 R

[51] Int. Cl.[2] ..... F23G 5/00; F23L 1/00; F23L 9/00

[58] Field of Search ..... 110/7 R, 8 R, 8 C, 14, 110/15, 18 R, 18 C, 72 R, 75 R, 75 A, 75 B

[56] References Cited

UNITED STATES PATENTS

| | | | |
|---|---|---|---|
| 1,565,747 | 12/1925 | Miller | 110/75 |
| 1,620,488 | 3/1927 | Preston | 110/75 |
| 2,238,161 | 4/1941 | Drew et al. | 110/14 |
| 3,395,655 | 8/1968 | Guy | 110/15 |

*Primary Examiner*—Kenneth W. Sprague
*Attorney, Agent, or Firm*—McGlew and Tuttle

[57] ABSTRACT

A combustion furnace particularly for refuse incineration comprises furnace walls which enclose a fire chamber having a grate extending across at least a part of the fire chamber of the furnace. The furnace walls have a portion adjacent the grate which comprises inner and outer spaced metal walls with a hollow space between said walls. A metal shield plate is spaced inwardly from said inner furnace wall and extends around at least a substantial portion of the periphery of the grate which is adjacent the furnace walls and there is an intermediate hollow space between the shield plate and the inner furnace wall. The inner metal furnace wall has openings communicating with the hollow space between the inner and the outer furnace walls and the shield plate has openings communicating with the intermediate hollow space between the shield plate and the inner furnace wall with the fire chamber. Means are provided for supplying air into the hollow space between the inner and outer furnace walls which flows through the openings of the inner wall to the space between the inner wall and the shield and also through the openings of the shield to the furnace chamber so that it both aids in the combustion and in cooling the metal shield plate and the furnace walls.

10 Claims, 9 Drawing Figures

PRIOR ART

COMBUSTION FURNACE CONSTRUCTION PARTICULARLY A REFUSE INCINERATOR

BACKGROUND OF THE INVENTION

1. Field of the Invention

This invention relates in general to the construction of furnaces and in particular to a new and useful combustion furnace particularly a refuse incinerator which includes a double metal wall construction and a shield plate spaced inwardly from the walls surrounding the metal grate at least in the area in which the grate is close to the furnace walls and with means for directing air into the space between the metal walls for flow through openings therein to the space between the inner metal wall and the metal shield plate and for eventual flow through openings in the shield plate to the furnace chamber.

2. Description of the Prior Art

Walls of refuse incinerators are usually made of solid masonry even in the fire zone which is in the vicinity of the hearth or a grate upon which the material is burned. With such furnaces the temperature on the inner surface of the furnace walls can rise to such values that the ashes coming into contact with the wall are melted and deposited thereon in the form of coarse slag beads especially in the areas of the furnace walls which are directly adjacent the grate. These formations tend to increase in size inwardly so that they obstruct the grate and they must be cut off periodically. This is a time consuming process and requires cooling and subsequent reheating of the furnace and the stoppage of the furnace may take up to several days. In addition the cutting off of the slag which forms usually causes damage on the furnace walls and makes repair work necessary.

SUMMARY OF THE INVENTION

The present invention provides an improved combustion furnace particularly for the incineration of refuse in which the disadvantages of the prior art are avoided by a construction which assures that the inner wall surfaces adjacent the fireplace cannot get heated to temperatures at which the ashes become melted, and formed on the walls in the form of a slag. In accordance with the invention the furnace is provided at least in the area adjacent to the grate with a mantle enclosing the fire zone which is designed as a metal hollow wall shielded at the inside by a metal plate wall spaced inwardly thereform. The hollow furnace wall communicates through openings in the inner furnace wall to the space between the inner furnace wall and the metal shield plate and the metal shield plate is provided with openings for communicating the space between the shield plate and the inner wall with the furnace chamber. Means are provided for supplying air into the hollow furnace wall space which flows through the openings therein into the space between the inner furnace wall and the shield plate and eventually into the furnace chamber and thereby aids in the combustion in the furnace chamber.

The air supplied into the hollow wall not only cools the inner shell of the hollow wall but it also cools the area directly adjacent the grate and the metal shield plate. In addition the air participates as a secondary air in the combustion process. This is very desirous because a large quantity of additional air is especially needed for satisfactory burning particularly for the incineration of refuse. In many arrangements the entire air supply for cooling of the wall portion adjacent the fireplace grate is advantageously fed into the furnace as additional air. In some instances it is also desirable to evacuate a portion of the air in the event that the quantity of secondary air which is required in the combustion process is less than that which is necessary for cooling the wall.

Accordingly it is an object of the invention to provide an improved combustion furnace wherein the furnace walls are made of inner and outer metal wall portions with the inner wall portion having openings communicating with a hollow space formed between a shield plate which is arranged inwardly from the inner wall around a major portion of the grate which is adjacent the furnace wall, and with means for circulating air through the space between the furnace walls and through openings in the inner wall into the space between the inner wall and the inner shield plate and also through openings in the inner shield plate to the combustion chamber.

A further object of the invention is to provide a combustion furnace which is simple in design, rugged in construction and economical to manufacture.

For an understanding of the principles of the invention, reference is made to the following description of typical embodiments thereof as illustrated in accompanying drawings.

DESCRIPTION OF THE PRIOR ART

Figure 1:
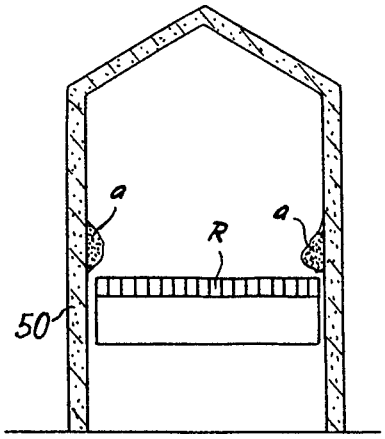
Fig. 1 PRIOR ART
FIG. 1 is a transverse view of a furnace constructed in accordance with the prior art.
Figure 2:
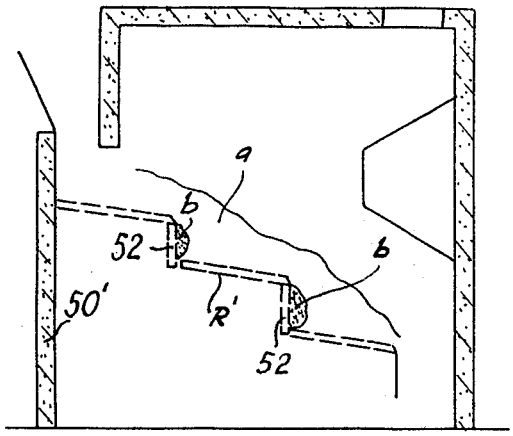
FIG. 2 is a longitudinal sectional view of a further example of a prior art furnace construction.

As indicated in FIGS. 1 and 2 a refuse incinerator of the known type such as the furnace shown in FIG. 1 with the grate R or the furnace shown in FIG. 2 with the grating R′ includes furnace walls 50 and 50′ which are usually made up of solid masonry or refractory material. During the operation of such a furnace annoying slag beads a in the furnace 1 or *b* in the furnace 2 tend to build up on the inside of the wall portions which are close to the grate and on the intermediate walls 52 which are at the step of the grating R′ as shown in FIG. 2. From time to time the beads are cut off and this requires a cooling of the furnace and a furnace shut down for a considerable period of time and also there is a danger that the removal of the slag will cause damage to the furnace.

GENERAL DESCRIPTION OF THE PREFERRED EMBODIMENTS

Figure 3:
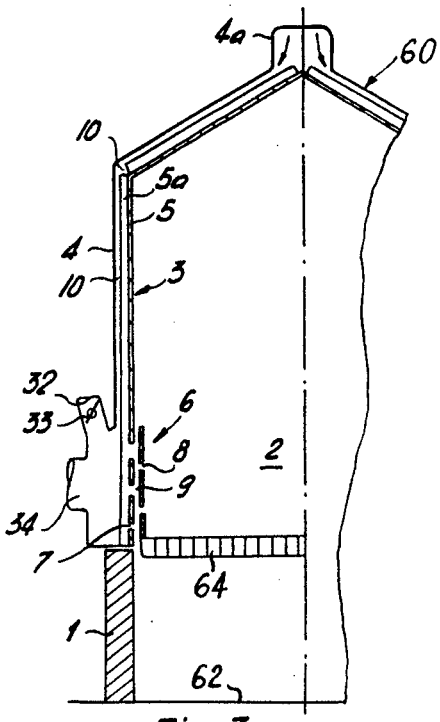
FIG. 3 is a transverse sectional view of a furnace constructed in accordance with the invention.

As shown in FIG. 3 there is provided a furnace generally designated 60 which includes furnace walls generally designated 3 enclosing a fireplace or fire chamber 2. In accordance with the invention the furnace walls 3 are constructed as a double wall construction with a hollow interior space and this wall structure is mounted on a masonary base 1 which is built upwardly from a foundation or bottom 62.

In accordance with the invention the furnace wall 3 comprises an outer sheet metal shell 4 which includes an upper portion forming an air duct 4a. Furnace wall 3 also includes an inner sheet metal wall or shell 5 which is supported by the base 1 independently of the outer wall 4. The inner wall is provided with a plurality of vertically extending ribs 5*a* which project perpendicularly into the hollow space 10 defined between the inner wall 5 and the outer wall 4. The inner and outer walls 4 and 5 are not directly interconnected to each other so that they are relatively free and expansible.

The furnace 60 includes a grate 64 and the periphery of the grate at least in a portion thereof which is adjacent the furnace wall 3 is provided with a plate wall or metal shield plate 6 which is made of a heat resistant steel or cast iron and is mounted so as to shield the inner wall 5 from the furnace chamber 2. The shield plate 6 is spaced from the inner wall 5 so as to form an interspace or intermediate hollow space 9. At locations behind the shield plate 6 the inner wall is provided with openings 7 which are offset relative to openings 8 which are provided in the shield wall 6. Thereby a communication is established between the hollow space 10 and the interspace 9 through openings 7 and between the interspace 9 and the fire chamber 2 through the openings 8.

During the operation of the furnace air is supplied to the hollow space 10 of wall 3 for example by an appropriate connection of the air duct 4*a* and the air flows through the channels formed by ribs 5*a* downwardly and absorbs heat while cooling the inner wall 5. The air passes through the openings 7 into the interspace 9 behind the shield plate 6 so that the plate is also cooled and thereupon the flow is from the interspace 9 through openings 8 into the fire chamber so that the air aids in the combustion of the refuse. The openings 8 are dimensioned so that the velocity of the secondary air flow through the openings 7 is relatively high. However because air velocity through only small openings are concerned relatively high $\alpha$ values may be obtained.

Figure 4:
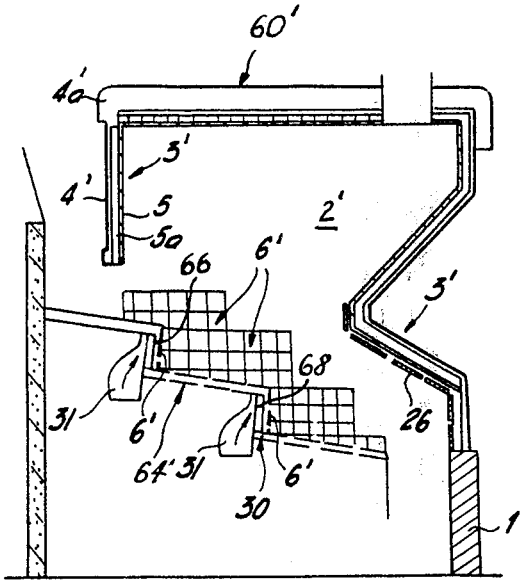
FIG. 4 is a longitudinal sectional view of another embodiment of the furnace.

FIG. 4 shows a similar arrangement for a furnace 60' wherein similar parts are similarly designated. In this embodiment the shield plates 6' are shown at each side of the furnace and they are also provided at grate steps 66 and 68. This embodiment also includes continuous perforated large shield plates 26 which are located particularly in places where the furnace wall overhangs the grate 64'. The step grate 64' has intermediate walls which are formed as hollow walls 30 which communicate through passageways 31 with an air supply and they are perforated on the side of the furnace chamber and shielded on this same side by the shield plates 6' having openings which are offset relative to those provided in the wall 30. Thus the critical locations of the grate are also cooled and the slag depositions are prevented. Due to the desired air cooling system the surface temperature of the shielding plate portions facing the fireplace can be reduced to 600° C so that a melting and deposition of the slag is prevented. On the other hand the inflowing secondary air absorbs such a quantity of heat that its temperature at the entrance of the fireplace may rise up to 300° C which is also advantageous. Should there be a need for more air for cooling of the plate walls than is necessary for the combustion, the air in excess after having passed through the hollow space 10 can be evacuated to the outside. For this purpose an outlet connection 32 is provided as shown in the embodiment of FIG. 3. This outlet connection has an adjustable air flap 33. Instead of supplying air from the duct connection 4a the air may also be supplied into the hollow space 10 in the zone near the grate for example at the location 34 indicated in FIG. 3.

Figure 5:
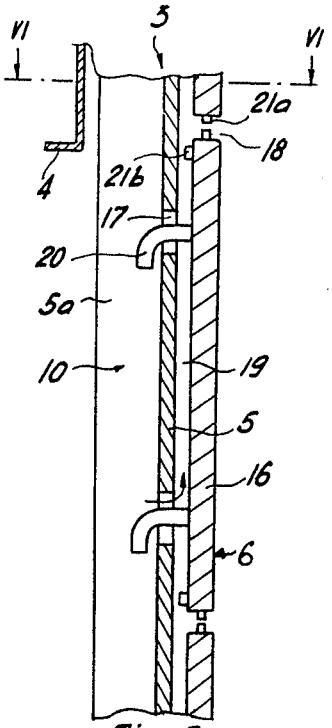
FIG. 5 is an enlarged vertical sectional view of a furnace wall showing another embodiment of wall construction.
Figure 7:
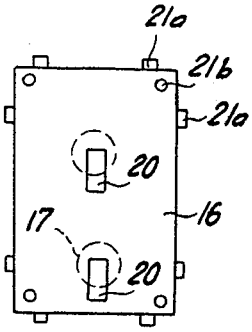
FIG. 7 is an elevational view of the back side of a single metal plate of the shielding metal plate wall which may be used in the furnaces shown in FIGS. 3 to 6.
Figure 6:
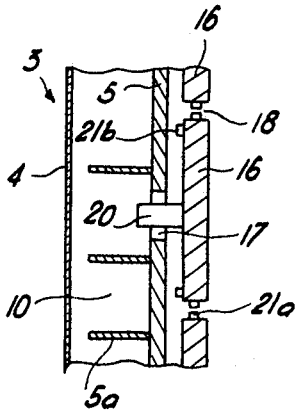
FIG. 6 is a sectional view taken along the line VI—VI of FIG. 5.

As shown in FIGS. 5, 6 and 7 the furnace wall generally designated 3 and the portion near the grate may have a shielding plate wall generally designated 6. The inner metal plate wall 5 of the furnace 3 is provided with round openings 17 and plates 16 are suspended by back-side hooks 20 so as to leave an interspace 19 therebetween. The cross-section of the hooks 20 is relatively small compared to the round openings 17 so that a free passage of air from the hollow space 10 of the wall 3 into the interspace 19 is not hindered. At their edges the plates 16 are spaced from each other so that air passage gaps 18 are formed which are offset with respect to the openings 17. The desired mutual spacing of the plates as well as the spacing of the plates 16 from the inner wall 5 is insured by marginal dogs 21*a* and 21*b.*

Figure 8:
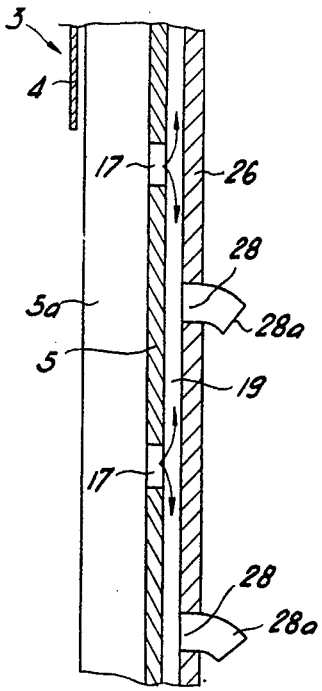
FIG. 8 is a view similar to FIG. 5 of another embodiment of the invention.

As shown in FIG. 8 instead of using a relatively small single plate 16, the plate wall may also be formed by a large plate 26 extending over the whole respective side of the furnace. The interspace 19 also communicates through openings 17 to the space between the inner and outer furnace walls and through openings in the plate 26 through the furnace chamber. In addition in order to be able to direct the secondary air passing through the openings 28 against the grate, appropriately bent pipe pieces 28*a* are fixed to the openings as shown in FIG. 8.

Figure 9:
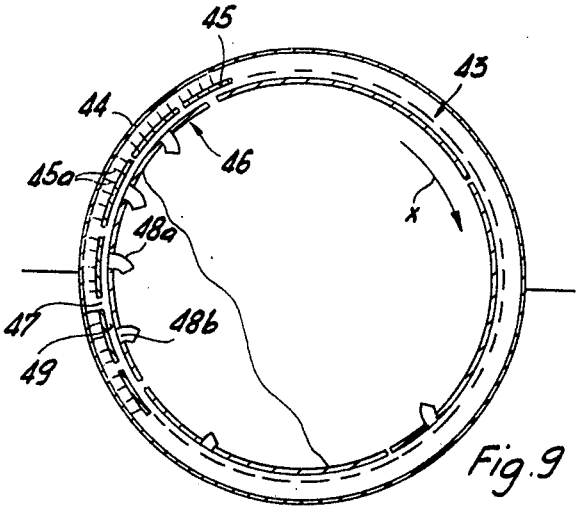
FIG. 9 is a horizontal sectional view of a rotary furnace showing another embodiment of the invention.

Another embodiment is shown in FIG. 9 wherein the construction is advantageous for use in rotary furnaces. The outer shell 44 of a cylindrical furnace wall 43 is stationary while the inner sheet metal shell 45 which is provided with longitudinal ribs 45*a* is rotatable. The inner wall 45 is provided with openings 47 and shielded with a circular or cylindrical plate wall 46 which leaves an interspace 49 therebetween. Openings 48 are provided in the plate wall 46 which are offset in respect to the openings 47 of the rotatable inner wall 45. To prevent penetration of the incinerated material through the openings 48 into the interspace 49 during the rotation of the inner wall 45 and the plate 46, pipe knees 48 are affixed to the openings 48 and project into the furnace chamber so that their orifices are directed in a direction opposite to the direction of rotation.

All of the furnaces of the invention are not only simple in construction and easy to maintain but owing to the effect of preheating of the secondary air are particularly economical in operation.

While specific embodiments of the invention have been shown and described in detail to illustrate the application of the principles of the invention, it will be understood that the invention may be embodied otherwise without departing from such principles.

What is claimed is:

1. A combustion furnace particularly for refuse incineration, comprising furnace walls enclosing a fire chamber having a grate extending across at least a portion of the fire chamber above the bottom thereof, said furnace walls having a portion adjacent said grate comprising inner and outer spaced metal walls with a hollow space between said walls, a metal shield plate spaced inwardly from said inner furnace wall and extending around at least the substantial portion of the periphery of said grate which is adjacent said furnace walls and defining an intermediate hollow space between said shield plate and said inner furnace wall, said inner metal wall having openings communicating said hollow space with the space between said inner wall and said shield plate, said shield plate having openings communicating the intermediate space between said shield plate and said inner furnace wall with said fire chamber, and air supply means for supplying air into the hollow space between said inner and outer metal walls.

2. A combustion furnace according to claim 1, wherein the openings of said inner wall are offset from the openings of said shield plate wall.

3. A combustion furnace according to claim 1, wherein said shield plate wall comprises a plurality of individual plates, said plates being mounted to form a wall in a spaced arrangement, the spacing between said plates comprising the openings of said plate wall.

4. A combustion furnace according to claim 1, wherein said metal shield plate comprises an individual plate having hooks thereon which extend outwardly from the interior surface thereof and engage into the openings of said inner wall to suspend said shield plate outwardly from said inner wall, and dogs carried by said shield plate providing spacing means for said shield plate for spacing said shield plate away from said inner wall.

5. A combustion furnace according to claim 1, wherein said shield plate comprises a continuous plate provided with openings which are offset relative to the openings of said inner wall.

6. A combustion furnace according to claim 1, including a short length of pipe in at least some of the openings of said shield plate.

7. A combustion furnace according to claim 1, wherein said grate comprises a step grate, said furnace walls including intermediate walls at the location of each step of said grate, said air supply means also being connected to said furnace walls at the location of said grate steps.

8. A combustion furnace according to claim 1, wherein said furnace comprises a rotary furnace, said inner and outer walls being substantially cylindrical and said inner wall being rotatable relative to said outer wall.

9. A combustion furnace according to claim 8, wherein said shield plate is a cylindrical plate and includes a plurality of short length of pipe in at least some of the openings thereof which project inwardly into the fire chamber and are curved in a direction opposite to the direction of rotation of said inner wall, said plate being rotatable with said inner wall.

10. A combustion furnace according to claim 1, wherein said furnace includes a supporting base, said inner and outer furnace walls resting on said supporting base and being independently movable relatively to each other, said inner wall being provided with rear portions which project into the space between said inner and outer walls.

* * * * *